US009533354B2

(12) United States Patent
Lee et al.

(10) Patent No.: US 9,533,354 B2
(45) Date of Patent: Jan. 3, 2017

(54) METHOD FOR PREPARING SIZE-CONTROLLED GOLD NANOPARTICLES AND COLORIMETRIC DETECTION METHOD OF STRONG ACID USING THE SAME

(71) Applicant: Korea Basic Science Institute, Daejeon (KR)

(72) Inventors: Gae Hang Lee, Daejeon (KR); Doo Ri Bae, Daejeon (KR); Yeon Suk Choi, Daejeon (KR)

(73) Assignee: Korea Basic Science Institute, Daejeon (KR)

( * ) Notice: Subject to any disclaimer, the term of this patent is extended or adjusted under 35 U.S.C. 154(b) by 407 days.

(21) Appl. No.: 14/087,159

(22) Filed: Nov. 22, 2013

(65) Prior Publication Data

US 2014/0377876 A1 Dec. 25, 2014

(30) Foreign Application Priority Data

Jun. 19, 2013 (KR) ..... 10-2013-0070357

(51) Int. Cl.
*G01N 21/80* (2006.01)
*G01N 21/77* (2006.01)
(Continued)

(52) U.S. Cl.
CPC ..... *B22F 9/24* (2013.01); *B22F 1/0018* (2013.01); *Y10T 428/2982* (2015.01); *Y10T 436/15* (2015.01); *Y10T 436/156666* (2015.01)

(58) Field of Classification Search
CPC ..... G01N 21/80; G01N 21/78; G01N 21/77; G01N 21/75; G01N 21/00; Y10T 436/15; Y10T 436/156666; B22F 1/0018; B22F 1/0011; B22F 1/0007; B22F 1/0003; B22F 9/24; B22F 9/18; B22F 9/16
(Continued)

(56) References Cited

U.S. PATENT DOCUMENTS

2011/0042210 A1 2/2011 Kang et al.
2012/0168692 A1 7/2012 Son, Il et al.
2014/0199773 A1* 7/2014 Han ..... G01N 31/22 436/101

FOREIGN PATENT DOCUMENTS

JP 2005-290478 A 10/2005
KR 10-0795480 A 10/2007
(Continued)

OTHER PUBLICATIONS

Dahl et al, Toward Greener Nanosynthesis, Chem. Rev., 2007, pp. 2228-2269.*
(Continued)

*Primary Examiner* — Christine T Mui
(74) *Attorney, Agent, or Firm* — Additon, Higgins & Pendleton, P.A.

(57) ABSTRACT

A method for preparing hydrophobic gold nanoparticles includes adding 1,2-dichlorobenzene as a solvent to gold precursor and using oleylamine and oleic acid with volume ratio of 7.5:2.5 to 5:5 as surfactants. The size of the prepared gold nanoparticles can be controlled over a broad range and may be utilized in various fields such as bio-imaging, photonic crystallization, sensors, organic catalysts, surface enhanced raman spectrum, electronic devices, etc. Further, a method for colorimetric detection of a strong acid uses hydrophilic nanoparticles that are phase transited from the prepared hydrophobic gold nanoparticles. Up to 5 ppm of low content hydrochloric acid can be detected utilizing phase transited hydrophilic nanoparticles in the colorimetric detection method, and the gold nanoparticles that were used
(Continued)

in the detection of strong acid can be reused without loss of activity through neutralization with bases.

5 Claims, 8 Drawing Sheets

(51) Int. Cl.
*B22F 1/00* (2006.01)
*B22F 9/24* (2006.01)

(58) Field of Classification Search
USPC ..... 436/102, 106, 100; 428/402, 357
See application file for complete search history.

(56) References Cited

FOREIGN PATENT DOCUMENTS

| | | | | | |
|---|---|---|---|---|---|
| KR | 10-0873176 | A | | 7/2008 | |
| KR | 10-1090431 | A | | 2/2011 | |
| KR | 2011-0028750 | A1 | | 3/2011 | |
| KR | 10-2011-0065232 | | | 6/2011 | |
| KR | 10-2011-0086881 | | * | 8/2011 | ..... G01N 33/182 |
| KR | 10-1208659 | B1 | | 12/2012 | |
| WO | 2013-032095 | A1 | | 3/2013 | |

OTHER PUBLICATIONS

Chen et al, Silver Nanoparticles Capped by Oleylamine: Formation, Growth and Self-Organization, Langmuir, 2007, 5296-5304.*

Tiwari et al, Gold Nanoparticles for Colorimetric detection of hydrolysis of antibiotics by penicillin G acylase, Advances in Bioscience and Biotechnology, 2010, 1, pp. 322-329.*

Mourdikoudis et al, Oleylamine in Nanoparticle Synthesis, Chem. Mater., Feb. 12, 2013, 25, pp. 1465-1476.*

Tripathy, et al., "Highly Selective Colorimetric Detection of Hydrochloric Acid Using Unlabeled Gold Nanoparticles and an Oxidizing Agent", American Chemical Society, Nov. 2011, pp. 9206-9212.

* cited by examiner

METHOD FOR PREPARING SIZE-CONTROLLED GOLD NANOPARTICLES AND COLORIMETRIC DETECTION METHOD OF STRONG ACID USING THE SAME

This application claims priority of Korean Patent Application No. 2013-0070357, filed on Jun. 19, 2013, in the Korean Intellectual Property Office, which is hereby incorporated by reference in its entirety.

BACKGROUND OF THE INVENTION

Field of the Invention

The present invention relates to a method for preparing size-controlled gold nanoparticles and a colorimetric detection method of strong acid using them, and more particularly, to a method for preparing hydrophobic gold nanoparticles, capable of controlling sizes of particles over a broad range by preparing gold nanoparticles with regulating volume ratio of two types of surfactant, and a colorimetric detection method of strong acid, capable of detecting up to low content hydrochloric acid of 5 ppm by utilizing the phase transited hydrophilic nanoparticles in colorimetric detection for detecting aqueous strong acid after phase-transiting the prepared hydrophobic gold nanoparticles into hydrophilic gold nanoparticles.

Description of the Related Art

Metal nanoparticles, among nano-size materials, have chemical and physical properties distinguishable from bulk metals, so the metal nanoparticles have been widely used in various fields. This is because surface area of a metal increases greatly when the metal reduces to nano size from a bulk state, and only small numbers of atoms exist in a nanoparticle and thus it exhibits unique catalytic, electric, photo-electric and magnetic properties. Such nanoparticles become superior catalysts having high surface-to-volume ratio due to their small size. Additionally, nanoparticles have relatively large surface tension and the surface tension activates remarkably atoms on the surface of the nanoparticles. Metal nanoparticles have been widely used in various fields such as energy conversion, photo catalyst, green chemicals, non-symmetric synthesis, biomimetic technology, molecular printing technology.

Gold nanoparticles are elements having also nano-size molecular structures and their surface-to-volume ratios vary depending on their sizes and thus the gold nanoparticles exhibit various electrical, optical and biological properties according to their spatial structures and orders of one, two and three dimension. Accordingly, researches for controlling the sizes of gold nanoparticles are being made progressively in various applications, and until now, researches to adjust the size of gold nanoparticles by controlling reaction temperature, reaction time, and concentration of reactants have been made.

Meanwhile, hydrochloric acid is used for removing rusts in iron oxide, etc., or plating metals in the industrial sites. Additionally, hydrochloric acid is also used in large scale processes of manufacturing organic compounds such as vinyl chloride, PVC, poly urethane, etc., and in manufacturing process of food additives such as gelatin and leather treatments and so on. With the rapid progress of industrialization and its large scale growth, the amount of hydrochloric acid used in the industry is increasing. When hydrochloric acid is exposed to natural environment and human, dehydration through the combination with protein of an organic matter is caused to occur, exhibiting harmful effects such as destruction of protein structure, damage to cell membrane, and destruction of cell, etc. In order to prevent such harmful effects, researches for detecting the amount of hydrochloric acid in the water are being made actively. Conventionally, the methods for detecting hydrochloric acid are performed by observing the variations of electrochemical property, optochemical property, mass, and imaging, etc., thereof. Most of those methods are performed to detect hydrochloric acid in a gaseous phase, however, various kinds of salts and acids exist in the water and thus it is difficult to detect specially only minute amount of hydrochloric acid.

Recently, a method has been developed for calorimetric detection of 100 ppm of hydrochloric acid by using a phenomenon where gold nanoparticles are corroded with hydrochloric acid to reduce their sizes and change color of the solution thereof. However, the level of 100 ppm is higher than the allowance standard of concentration about hydrochloric acid exposure prescribed by United States Department of Labor. Accordingly, it is necessary to develop a method for detecting simply and rapidly hydrochloric acid of ultralow concentration.

SUMMARY OF THE INVENTION

An object of the present invention is to provide a method for synthesizing gold nanoparticles of high quality, capable of controlling size of particles over a broad range using a simple preparing process.

Another object of the present invention is to provide hydrophobic gold nanoparticles with 11 to 54 nm of particle size that were prepared by the above method.

Further, another object of the present invention is to provide a method for detecting up to 5 ppm of ultralow concentration hydrochloric acid in the water by utilizing electrostatic attraction of the phase transited hydrophilic nanoparticles after the hydrophobic gold nanoparticles is phase transited into hydrophilic gold nanoparticles.

An aspect of the present invention relates to a method for preparing gold nanoparticles, including steps of: adding 1,2-dichlorobenzene to gold precursor as a solvent, adding oleylamine and oleic acid with volume ratio of as surfactants, and then magnetic-stirring it; and cooling the mixture in which a reaction is completed to room temperature and purifying the product.

Another aspect of the present invention relates to hydrophobic gold nanoparticles with 11 to 54 nm of average radius that were prepared by the above preparing method.

Further, another aspect of the present invention relates to a method of detecting a strong acid, including steps of: preparing mono-dispersed hydrophobic gold nanoparticles with 11 to 54 nm of average radius that were prepared by the method; preparing dispersed solution by dispersing the hydrophobic gold nanoparticles in chloroform; adding aqueous solution of 0.05 to 0.5M cetyltrimethyl ammonium bromide (CTAB) to the dispersed solution and magnetic-stirring it; yielding hydrophilic gold nanoparticles by separating centrifugally the mixture in which a reaction is completed and removing remaining surfactant; and adding an aqueous solution containing hydrochloric acid to a test tube where the hydrophilic gold nanoparticles are immersed, heating the test tube at 50° C.~100° C. for 5 to 10 minutes and then observing color changes within the test tube.

BRIEF DESCRIPTION OF THE DRAWINGS

The above and other aspects, features and advantages of certain exemplary embodiments of the present invention will be more apparent from the following description taken in conjunction with the accompanying drawings, in which.

DETAILED DESCRIPTION OF EXEMPLARY EMBODIMENTS

Figure 1A:
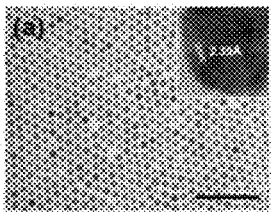
FIG. 1*a* is a TEM photograph of gold nanoparticles prepared by the method of comparison embodiment 1 of the present invention.

Exemplary embodiments of the present invention will be described below in detail.

The implement embodiments of the present invention provides a method for preparing hydrophobic gold nanoparticles, capable of controlling the size of particles up to approximately 440% by adjusting composition ratio of a surfactant used in a predetermined reaction system. When Cetyl Trimethyl Ammonium Bromide (CTAB), a cation surfactant is added to the hydrophobic gold nanoparticles that are prepared as being mono-dispersed with average radius of 11 to 54 nm, the hydrophobic gold nanoparticles are phase transited into hydrophilic gold nanoparticles. The phase transited hydrophilic gold nanoparticles acts as a sensing agent for detecting strong acid wherein low concentration hydrochloric acid of 5 ppm can also be sensed in the water.

In the present invention 1,2-dichlorobenzene as a solvent and oleylamine and oleic acid as surfactants are added to gold precursor in order to prepare gold nanoparticles wherein volume ratio of oleylamine to oleic acid is set as 7.5:2.5 to 5:5 to control the size of nanoparticles prepared over a broad range. All reactions can be performed using 2 bulbs round bottom flask under 1 atm.

At a room temperature, 20 to 50 ml of 1,2-dichlorobenzene, 5 to 7.5 ml of oleylamine and 2.5 to 5 ml of oleic acid are added to 1 to 3 g of gold precursor and then the mixture is magnetic-stirred for 10 minutes to one hour. Consecutively, the reaction liquid is magnetic-stirred at 50° C. to 200° C. for 1 to 3 hours. At this time, when the reaction temperature is lower than 50° C., reduction reaction of the gold precursor may not occur, and when the reaction temperature exceeds 200° C., the solvent may be vaporized. When the reaction is completed, the mixture within the reacting container is cooled to a room temperature, washed several times with ethanol, and then surfactant which is remained after centrifugation at 2,000 to 3,000 rpm for 5 to 10 minutes is removed and final solid product, that is, gold nanoparticles are collected. Average radius of yielded gold nanoparticles is 11 to 54 nm wherein the particles are easily soluble in nonpolar organic solvents such as hexane, toluene, chloroform, chlorobenzene, etc.

As the gold precursor material, $HAuCl_4.3H_2O$, AuCl, $AuCl_3$ or $AuBr_3$ may be used and $HAuCl_4.3H_2O$ is used preferably in order to synthesize uniform nanoparticles.

One of causes that determine the size of nanoparticles is the boding intensity of surfactant that is bonded to the surface of nanoparticles. When the surfactant is bonded strongly to the surface of the nanoparticles while the nanoparticles are prepared, the sizes of the particles are decreased, and when the surfactant is bonded weakly to the surface of the nanoparticles, the sizes of the particles are increased. In exemplary embodiments of the present invention, two types of surfactants, oleylamine and oleic acid are used at the same time, and the sizes of the nanoparticles that are prepared can be controlled by adjusting respective volume ratio over a broad range. That is, when the gold nanoparticles are prepared, a mixed surfactant composed of two types of surfactants, oleylamine and oleic acid is used, and at this time when the content of oleylamine becomes higher, the sizes of the gold nanoparticles prepared are decreased further and become more uniform since oleylamine is bonded stronger to the surface of the gold nanoparticles than oleic acid. On the contrary, when the content of oleic acid in the mixed surfactant of two types of surfactants becomes higher, the sizes of gold nanoparticles prepared are increased further.

More specifically, inventors of the present invention found that the sizes of the gold nanoparticles prepared can be controlled to most broad range when volume ratios of the oleylamine and oleic acid are adjusted to 7.5:2.5, 6.5:3.5 and 5:5, respectively. When the volume ratio of oleylamine and oleic acid is 7.5:2.5, hydrophobic gold nanoparticles with 11 nm of average radius are prepared, and when the volume ratio is 6.5:3.5, hydrophobic gold nanoparticles with 32 nm of average radius are prepared. Additionally, when the volume ratio of oleylamine and oleic acid is 5:5, hydrophobic gold nanoparticles with 54 nm of average radius are prepared.

Likewise, according to the method for preparing gold nanoparticles of the present invention, the sizes of particles can be controlled over a broad range, comparing to the case where the gold nanoparticles are prepared by adjusting reaction temperature, concentration of reactant and reaction time, and moreover, the process is so simple and low cost to be useful in preparing nanoparticles. Additionally, synthesized gold nanoparticles can be reused without loss of activity.

Hereinafter, a method for phase-transiting the prepared hydrophobic gold nanoparticles into hydrophilic gold nanoparticles will be described.

First, 1 to 100 mg of the yielded hydrophobic gold nanoparticles is dispersed in 0.5 to 100 ml of chloroform to prepare a dispersion solution. Subsequently, 1 to 100 ml of 0.05 to 0.5 M CTAB aqueous solution is added to the dispersion solution and then magnetic-stirred for 1 to 12 hours. The stirred solution is separated centrifugally at 2,000 to 3,000 rpm for 5 to 10 minutes and hydrophilic gold nanoparticles are yielded by removing remaining surfactant that is not reacted. The gold nanoparticles that are prepared by this method are phase transited and easily dispersed in hydrophilic solvents such as water, ethanol, and methanol, etc.

Figure 5A:
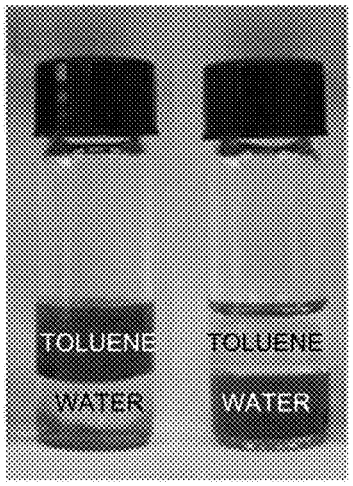
FIG. 5*a* is a photograph showing the gold nanoparticles that are dispersed in a solvent before and after phase transition, which are prepared by one implement embodiment of the present invention.

FIG. 5*a* is a photograph showing the gold nanoparticles that are dispersed in a solvent before and after phase transition, which are prepared by one implement embodiment of the present invention. Referring to FIG. 5*a*, it can be shown that the gold nanoparticles are dispersed in toluene of solvent organic before the phase transition, whereas the gold nanoparticles are dispersed only in the water after the phase transition.

Figure 5B:
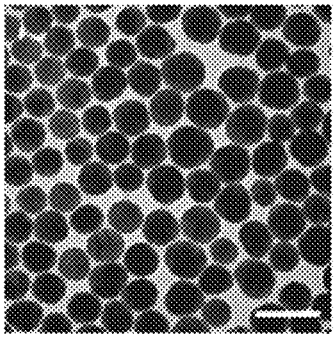
FIG. 5*b* is a low magnification TEM(Transmission Electron Microscope) photograph of the hydrophobic gold nanoparticles prepared by one implement embodiment of the present invention.
Figure 5C:
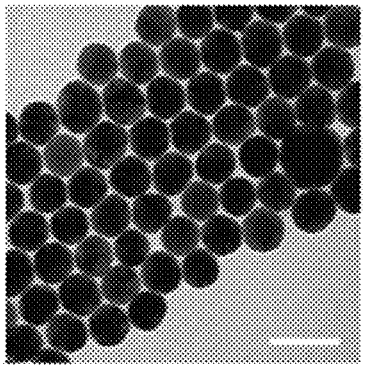
FIG. 5*c* is a low magnification TEM(Transmission Electron Microscope) photograph of the hydrophilic gold nanoparticles prepared by one implement embodiment of the present invention.

FIG. 5*b* is a low magnification TEM(Transmission Electron Microscope, Omega EM912, 120 kV) photograph of the hydrophobic gold nanoparticles prepared by one implement embodiment of the present invention, and FIG. 5*c* is a low magnification TEM(Transmission Electron Microscope) photograph (scale bar 100 nm) of the hydrophilic gold nanoparticles. Samples of the gold nanoparticles are discriminated by locating several drops of corresponding colloidal solution on carbon-coated copper grids (200 mesh, F/C coated, Ted pellar Inc.) and using TEM. According to FIGS. 5*b* and 5*c*, it can be shown that the sizes and shapes of hydrophilic gold nanoparticles are same as those of hydrophobic gold nanoparticles even after the phase transition.

In the present invention, the hydrophobic gold nanoparticles is chemical-treated with surfactant to be phase-transited into hydrophilic gold nanoparticles and the phase transited hydrophilic gold nanoparticles is utilized in a colorimetric detection method for detecting aqueous state strong acid. Hereinafter, a method for detecting colorimetrically hydrochloric acid of a typical strong acid in aqueous solution will be described.

First, aqueous solution containing 5 to 50 ppm of hydrochloric acid in 100 μl of water is put into a test tube where 4.5 to 45 μg of phase transited hydrophilic gold nanoparticles are immersed and then the test tube is shaken for 1 to 5 seconds. Consecutively, the test tube containing the gold nanoparticles and strong acid is put in an oven at 50 to 100° C. and then heated for 5 to 10 minutes. After that, color changes within the test tube is observed.

In the present invention, a schematic diagram of a chemical phenomenon which is occurred by adding hydrochloric acid to the hydrophilic gold nanoparticles is as the follows;

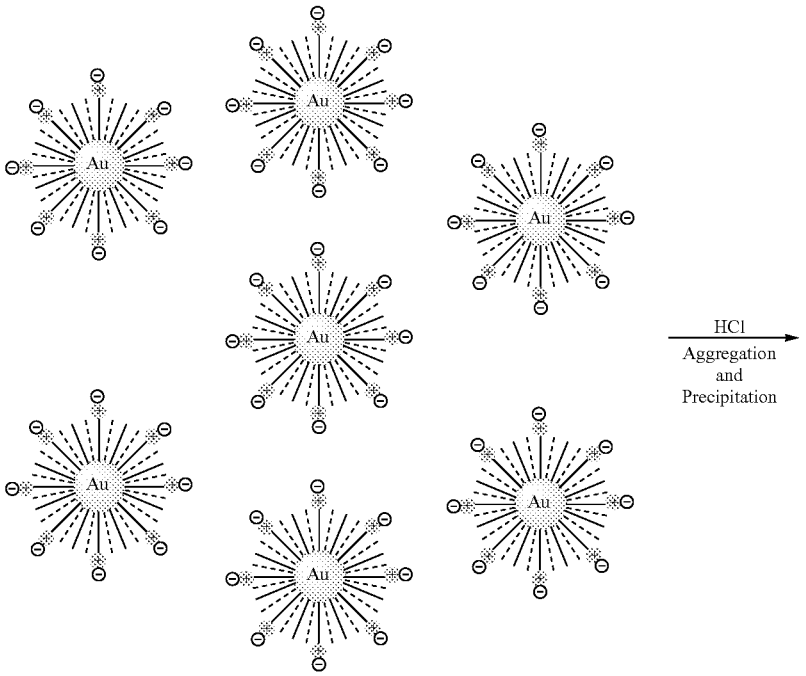

-continued

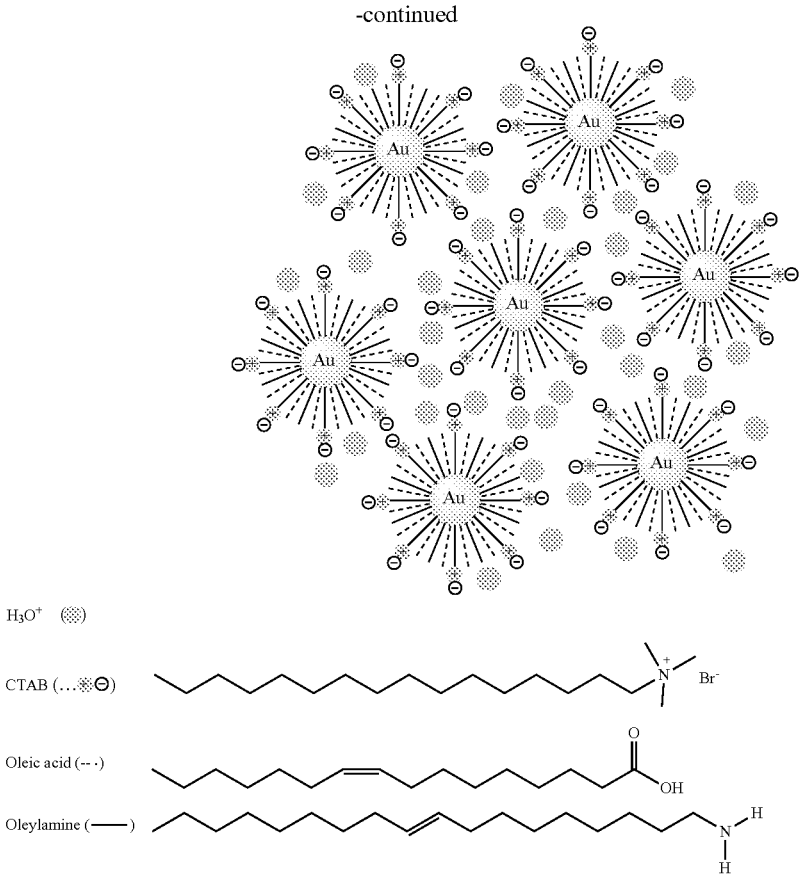

Referring to the above schematic diagram, it can be shown that the hydrogen ion that is dissociated while hydrochloric acid is dissolved in the water is bonded to water molecule to produce hydronium cation($H_3O^+$), and this hydronium cation is bonded to the surface of one hydrophilic gold nanoparticle with electrostatic attraction and the electrostatic attraction of the hydronium cation is applied to the adjacent gold nanoparticles, and thus the gold nanoparticles are agglomerated. As described above, when the gold nanoparticles of the present invention is mixed with with hydrochloric acid and the mixture is heated, the gold nanoparticles are agglomerated and precipitated by electrostatic attraction applied on the surface of gold nanoparticles, capable of detecting minute amount of hydrochloric acid.

At this time, the heating source for heating the test tube where the mixture of the gold nanoparticles and hydrochloric acid is immersed may include oven, heater or heating wire attachable/detachable to the test tube, however, it is not limited thereto necessarily.

While the invention will be described in conjunction with exemplary embodiments, these embodiments are just for understanding the present invention more clearly, not limiting the scope of the present invention.

Exemplary Embodiment 1: Preparing Gold Nanoparticles

At a room temperature, 30 ml of 1,2-dichlorobenzene (Aldrich, 99%), 7.5 ml of oleylamine(Aldrich, 70%) and 2.5 ml of oleic acid(Aldrich, 90%) were added to 2 g of $HAuCl_4.3H_2O$(Aldrich, 99.9%) and the mixture was magnetic-stirred for an hour, and then magnetic-stirred at 190° C. for two hours. After the reaction was completed, the mixture within the reactor was cooled to a room temperature, washed several times with 20 ml of ethanol (Aldrich, 99.9%) and 10 ml of toluene(Aldrich, 99%), and separated centrifugally at 3,000 rpm for 10 minutes to yield the gold nanoparticles by removing the remaining surfactant.

Exemplary Embodiment 2: Preparing Gold Nanoparticles

The gold nanoparticles were prepared in the same method as the exemplary embodiment 1 except that 6.5 ml of oleylamine and 3.5 ml of oleic acid were used as the surfactant.

Exemplary Embodiment 3: Preparing Gold Nanoparticles

The gold nanoparticles were prepared in the same method as the exemplary embodiment 1 except that 5 ml of oleylamine and 5 ml of oleic acid were used as the surfactant.

Comparison Embodiment 1: Preparing Gold Nanoparticles

The gold nanoparticles were prepared in the same method as the exemplary embodiment 1 except that 10 ml of oleylamine and 3.5 ml of oleic acid was used as the surfactant.

Analysis Method and Result Thereof about Prepared Gold Nanoparticles

FIGS. 1*a* to 1*d* are TEM(Transmission Electron Microscope) photographs showing the gold nanoparticles that were prepared in the exemplary embodiments 1 to 3 and the comparison embodiment 1, taken using low magnification TEM(Omega EM912, 120 kV) and high magnification TEM (Philips F20 Tecnai, 200 kV). Samples of the gold nanoparticles are discriminated by locating several drops of corresponding colloidal solution on carbon-coated copper grids (200 mesh, F/C coated, Ted pellar Inc.) and using TEM. Referring to FIG. 1, it can be shown that the gold nanoparticles are spherical and are mono-dispersed and that the surfaces of the particles are covered with oleylamine and oleic acid. Lattice spacing 2.35 is assigned through projecting the gold nanoparticles on a flat surface of a face-centered cubic structure (111) of gold. Additionally, clear lattice fringes can be shown through an observation with a high magnification TEM, thereby it can be known that the crystalline properties of the gold nanoparticles that were prepared in this method are excellent.

Figure 1B:
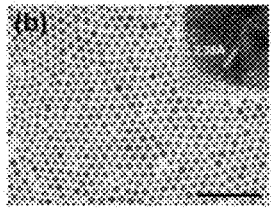
FIG. 1*b* is a TEM photograph of gold nanoparticles prepared by the method of exemplary embodiment 1 of the present invention.
Figure 1C:
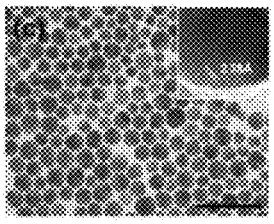
FIG. 1*c* is a TEM photograph of gold nanoparticles prepared by the method of exemplary embodiment 2 of the present invention.
Figure 1D:
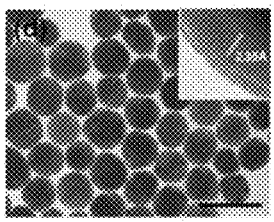
FIG. 1*d* is a TEM photograph of gold nanoparticles prepared by the method of exemplary embodiment 3 of the present invention.

It can be known that, according to FIG. 1*a*, the gold nanoparticles with 10 nm(10±0.1 nm) of average radius are prepared in case of the comparison embodiment 1 where only oleylamine is added as a surfactant, and that according to FIG. 1*b*, the gold nanoparticles with 11 nm(11±0.1 nm) of average radius are prepared in case of the exemplary embodiment 1 where volume ratio of oleylamine and oleic acid is 7.5:2.5. It can be known that, according to FIG. 1*c*, the gold nanoparticles with 32 nm(32±4.1 nm) of average radius are prepared when volume ratio of oleylamine and oleic acid is 6.5:3.5 and that according to FIG. 1*d*, the gold nanoparticles with 54 nm(54±7.5 nm) of average radius are prepared when volume ratio of oleylamine and oleic acid is 5:5.

Figure 2:
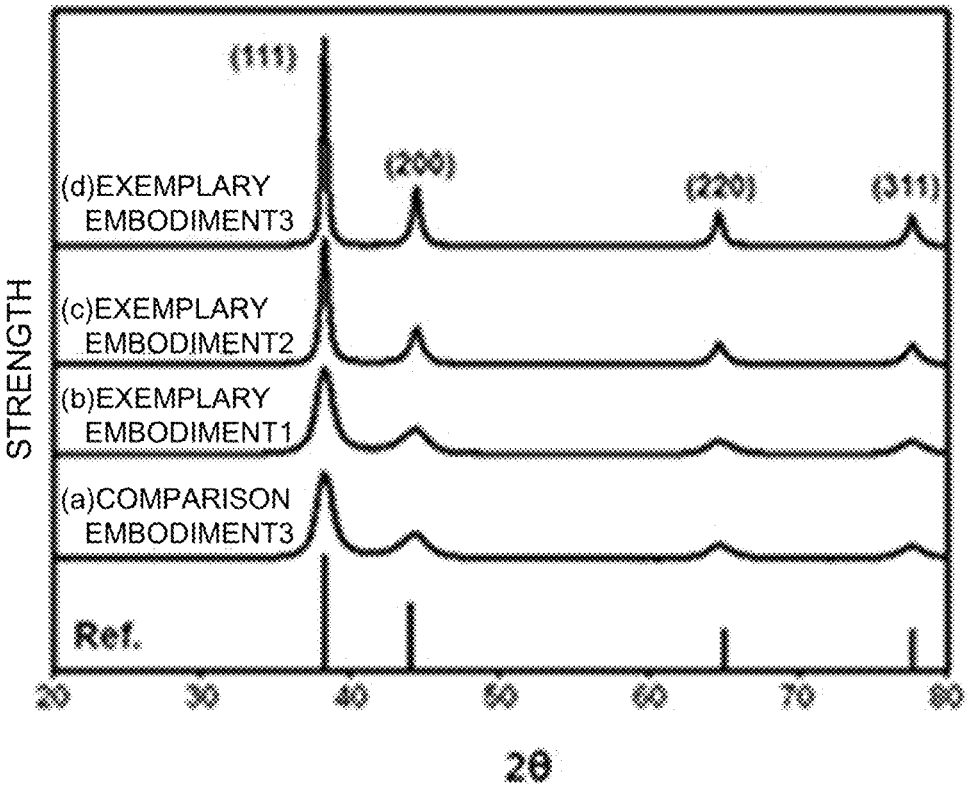
FIG. 2 is a view showing XRD data of gold nanoparticles prepared by the methods of exemplary embodiments 1 to 3 and comparison embodiment 1 of the present invention.

FIG. 2 shows XRD data of the gold nanoparticles that are prepared in the methods of the exemplary embodiments 1 to 3 and the comparison embodiment 1 wherein crystalline properties of spheres are shown. X-ray diffraction data were recoded with Rigaku D/MAX-RB diffraction analyzer at 12 kW. XPS (X-ray Photoelectron Spectroscopy) spectra were used to measure local chemical environment. Graphite-monochrome Cu—Kα radioactive ray was used at 40 kV and 120 mA as an X-ray source. According to X-ray powder diffraction spectrum shown in FIG. 2, main peaks of the gold nanoparticles that are prepared in the exemplary embodiments 1 to 3 correspond to JCPDS Card No. 04-0784, which is crystalline data of standard gold substance, and thus it can be known that the crystal structure of the prepared gold nanoparticles is a face-centered cubic structure(fcc). X-ray powder diffraction patterns of such sediments indicate the existence of metallic gold. Additionally, it can be known that diffraction peaks become sharper gradually with the increase of the sizes of the nanoparticles. When the sizes of gold nanoparticles are calculated from the XRD patterns using Debye-Scherrer equation, they are 9.3 nm, 10.4 nm, 30.1 nm, and 52.4 nm respectively, which corresponds to the sizes of the nanoparticles shown in FIG. 1.

Figure 3:
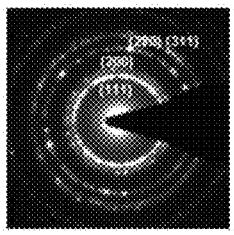
FIG. 3 is a photograph showing selected area electron diffraction of gold nanoparticles prepared by the method of exemplary embodiment 1 of the present invention.

FIG. 3 is a photograph showing selected area electron diffraction (SAED, Philips F20 Technai) of the gold nanoparticles that are prepared in the exemplary embodiment 1. SAED patterns of the prepared gold nanoparticles are identical chain patterns, which show multi-crystalline property. Analyzing electron diffraction data with TEM, it can be known that the circles are calculated with lattice surfaces (111), (200), (220), and (311), respectively, and that the lattice surfaces correspond to the face-centered cubic structure that is obtained in X-ray diffraction spectrum of FIG. 2.

Figure 4:
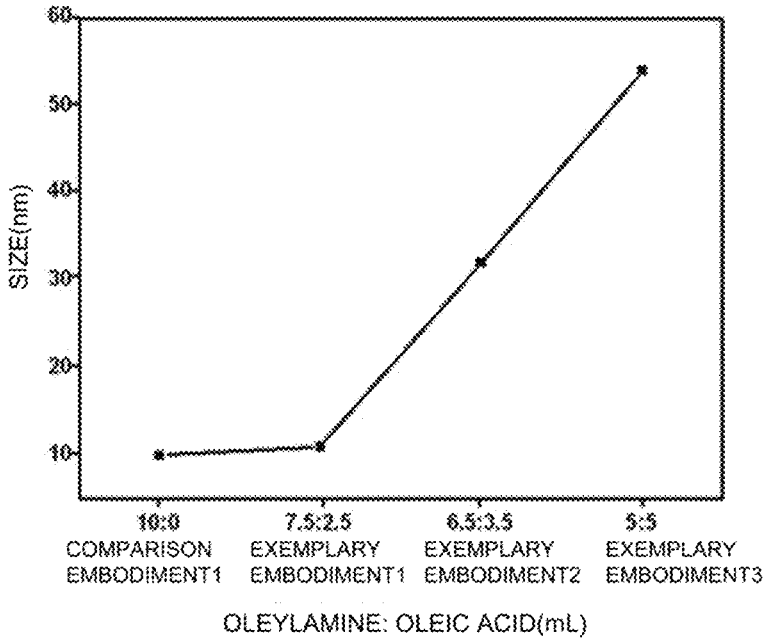
FIG. 4 is a graph showing the sizes of gold nanoparticles prepared by the methods of exemplary embodiments 1 to 3 and comparison embodiment 1 of the present invention.

FIG. 4 is a graph showing the sizes of the gold nanoparticles that are prepared in the exemplary embodiments 1 to 3 and comparison embodiment 1. As shown in FIG. 4, it can be known that the sizes of the gold nanoparticles increase as the volume ratio of oleic acid added increases.

Preparing Example 1: Preparing Hydrophilic Gold Nanoparticles

At a room temperature, 30 ml of 1,2-dichlorobenzene (Aldrich, 99%), 5 ml of oleylamine(Aldrich, 70%) and 5 ml of oleic acid(Aldrich, 90%) were added to 2 g of $HAuCl_4.3H_2O$(Aldrich, 99.9%) and the mixture was magnetic-stirred for an hour, and then magnetic-stirred at 190° C. for two hours. After the reaction is completed, the mixture within the reactor was cooled to a room temperature, washed several times with 20 ml of ethanol(Aldrich, 99.9%) and 10 ml of toluene (Aldrich, 99%) and separated centrifugally at 3,000 rpm for 10 minutes to yield 54 nm of hydrophobic gold nanoparticles by removing remaining surfactant that is not reacted. Here, 10 mg of the hydrophobic gold nanoparticles was dispersed in 1 ml of chloroform to prepare dispersed liquid. The dispersed liquid was added to 5 ml of 0.1M CTAB(Aldrich, 99%) aqueous solution and then the mixture was magnetic-stirred for 12 hours. The stirred solution was separated centrifugally at 6,000 rpm for 10 minutes. The sediments was washed with deionized water to remove remaining surfactant and yield hydrophilic gold nanoparticles.

Exemplary Embodiment 4: A Method for Detecting Hydrochloric Acid Using Gold Nanoparticles 45 μg of the gold nanoparticles that had been prepared in the preparing example 1 was immersed in 1 ml of a test tube. An aqueous solution containing 50 ppm of hydrochloric acid (Aldrich, 37%) in 100 μl of the water was poured in the test tube and the tube was shaken for 3 seconds, and then the test tube containing gold nanoparticles and hydrochloric acid was heated in an oven at 100° C. for 10 minutes, and color changes within the test tube were observed.

Exemplary Embodiment 5: A Method for Detecting Hydrochloric Acid Using Gold Nanoparticles 27 μg of gold nanoparticles that had been prepared in the preparing example 1 was immersed in 1 ml of a test tube. An aqueous solution containing 30 ppm of hydrochloric acid in 100 μl of the water was poured in the test tube and the tube was stirred for 3 seconds, and then the test tube containing gold nanoparticles and hydrochloric acid was heated in an oven at 100° C. for 10 minutes, and color changes within the test tube were observed.

Exemplary Embodiment 6: A Method for Detecting Hydrochloric Acid Using Gold Nanoparticles 9 μg of gold nanoparticles that had been prepared in the manufacturing example 1 was immersed in 1 ml of a test tube. An aqueous solution containing 10 ppm of hydrochloric acid in 100 μl of the water was poured in the test tube and the tube was stirred for 3 seconds, and then the test tube containing gold nanoparticles and hydrochloric acid was heated in an oven at 100° C. for 10 minutes, and color changes within the test tube were observed.

Exemplary Embodiment 7: A Method for Detecting Hydrochloric Acid Using Gold Nanoparticles 4.5 μg of gold nanoparticles that had been prepared in the manufacturing example 1 was immersed in 1 ml of a test tube. An aqueous solution containing 5 ppm of hydrochloric acid in 100 μl of the water was poured in the test tube and the tube was stirred for 3 seconds, and then the test tube containing gold nanoparticles and hydrochloric acid was heated in an oven at 100° C. for 10 minutes, and color changes within the test tube were observed.

Results of Exemplary Embodiments 4 to 7 and Considerations

Figure 6A:
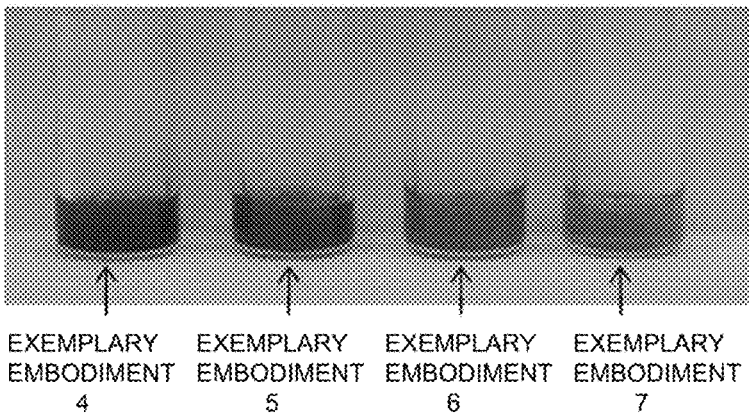
FIG. 6*a* is a photograph showing a solution within a test tube before adding aqueous solution of hydrochloric acid to a specimen of gold nanoparticles prepared by exemplary embodiments 4 to 7 of the present invention.
Figure 6B:
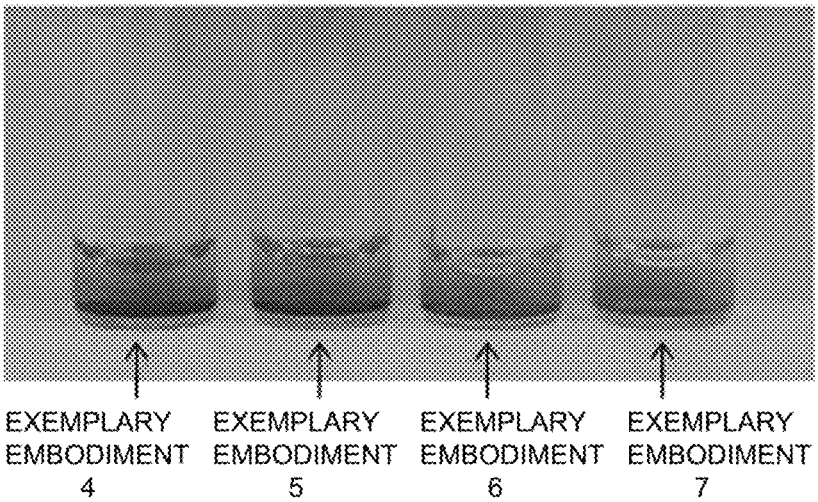
FIG. 6*b* is a photograph showing a solution within a test tube after adding aqueous solution of hydrochloric acid to a specimen of gold nanoparticles prepared by exemplary embodiments 4 to 7 of the present invention.

FIGS. 6*a* and 6*b* are photographs showing solutions within a test tube before adding hydrochloric acid aqueous solution to a specimen of the gold nanoparticles in the exemplary embodiments 4 to 7 (FIG. 6*a*) and after adding hydrochloric acid aqueous solution(FIG. 6*b*). Referring to FIG. 6*a*, it can be shown that a solution in which gold nanoparticles are dispersed in each test tube has red color, and that the color becomes thicker as the mass of dispersed gold nanoparticles increases. According to FIG. 6*b*, it can be understood that red color was disappeared after hydrochloric acid detection process and that sediments of agglomerated gold nanoparticles were produced differently from the state before adding hydrochloric acid aqueous solution.

Figure 7:
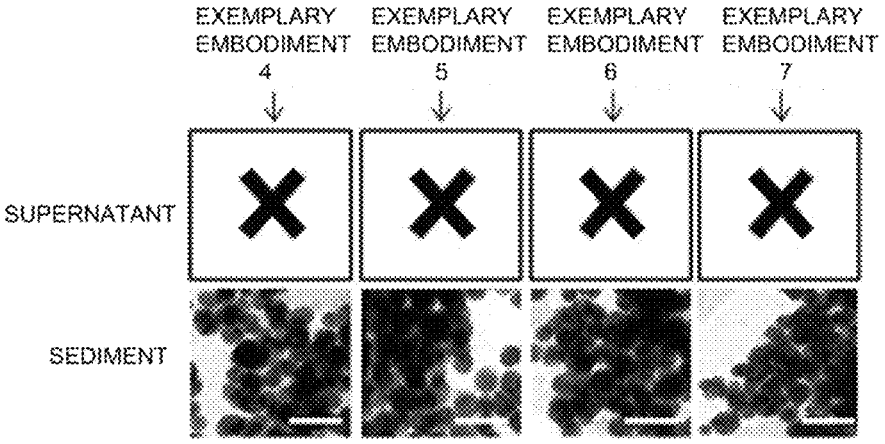
FIG. 7 is a TEM photograph showing a supernatant and deposits within a test tube after performing an experiment for detecting hydrochloric acid by exemplary embodiments 4 to 7 of the present invention.

FIG. 7 is a TEM photograph showing a supernatant and deposits within a test tube after performing an experiment for detecting hydrochloric acid in the exemplary embodiments 4 to 7. Referring to FIG. 7, gold nanoparticle is not found in the supernatant within the test tube after performing the experiment of hydrochloric acid detection in the exemplary embodiments 4 to 7, whereas agglomerated gold nanoparticles were observed in the sediments. That is, it can be known that the gold nanoparticles was not dispersed in the water, and sediments were formed and thus color of the solution was disappeared.

Hereinafter, various sorts of metallic salts and bases were mixed with the gold nanoparticles that had been prepared in preparing example 1 in a test tube and then the test tube was heated in an oven at 100° C. for 10 minutes, and color changes within the test tube were observed.

Comparison Embodiment 2: A Reaction of Gold Nanoparticles with Metallic Salts

90 μg of the gold nanoparticles that had been prepared in the preparing example 1 was immersed in 1 ml of a test tube. Here, 1,000 ppm of $Cu(NO_3)_2.3H_2O$ (Aldrich, 99104%) was put in the test tube and the tube was shaken for 3 seconds, and then the test tube where the gold nanoparticles are mixed with $Cu(NO_3)_2$ was heated in an oven at 100° C. for 10 minutes, the color changes within the test tube were observed.

Comparison Embodiment 3: A Reaction of Gold Nanoparticles with Metallic Salts

Except that 1,000 ppm of $Ni(NO_3)_2.3H_2O$ (Aldrich, 99.999%) was added to the test tube, instead of $Cu(NO_3)_2$, the experiment was performed in the same method as comparison embodiment 2, and the color changes within the test tube were observed.

Comparison Embodiment 4: A Reaction of Gold Nanoparticles with Metallic Salts

Except that 1,000 ppm of $CoSO_4.7H_2O$ (Aldrich, 99%) was added to the test tube, instead of $Cu(NO_3)_2$, the experiment was performed in the same method as comparison embodiment 2, and the color changes within the test tube were observed.

Comparison Embodiment 5: A Reaction of Gold Nanoparticles with Metallic Salts

Except that 1,000 ppm of $FeSO_4.7H_2O$ (Aldrich, ≥99.0%) was added to the test tube, instead of $Cu(NO_3)_2$, the experiment was performed in the same method as comparison embodiment 2, and the color changes within the test tube were observed.

Comparison Embodiment 6: A Reaction of Gold Nanoparticles with Metallic Salts

Except that 1,000 ppm of $ZnCl_2$ (Aldrich, 99.9%) was added to the test tube, instead of $Cu(NO_2)_2$, the experiment was performed in the same method as comparison embodiment 2, and the color changes within the test tube were observed.

Comparison Embodiment 7: A Reaction of Gold Nanoparticles with Metallic Salts

Except that 1,000 ppm of $FeCl_2.6H_2O$ (Aldrich, 97%) was added to the test tube, instead of $Cu(NO_3)_2$, the experiment was performed in the same method as comparison embodiment 2, and the color changes within the test tube were observed.

Comparison Embodiment 8: A Reaction of Gold Nanoparticles with Metallic Salts

Except that 1,000 ppm of $Na(C_2H_3O_2)$ (Aldrich, 99%) was added to the test tube, instead of $Cu(NO_3)_2$, the experiment was performed in the same method as comparison embodiment 2, and the color changes within the test tube were observed.

Comparison Embodiment 9: A Reaction of Gold Nanoparticles with Bases

Except that 1,000 ppm of KOH (Aldrich, ≥99.0%) was added to the test tube, instead of $Cu(NO_3)_2$, the experiment was performed in the same method as comparison embodiment 2, and the color changes within the test tube were observed.

Comparison Embodiment 10: A Reaction of Gold Nanoparticles with Bases

Except that 1,000 ppm of NaOH Aldrich, 97%) was added to the test tube, instead of $Cu(NO_3)_2$, the experiment was performed in the same method as comparison embodiment 2, and the color changes within the test tube were observed.

Results of Comparison Embodiments 2 to 10 and Considerations Thereof

Figure 8:
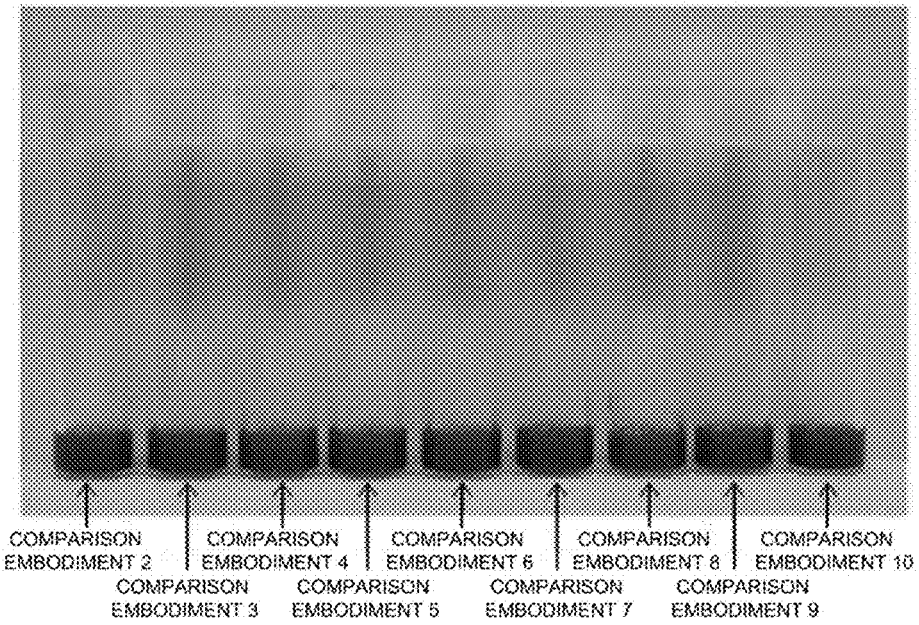
FIG. 8 is a photograph showing the reaction result of hydrophilic gold nanoparticles with metallic salts and bases in comparison embodiments 2 to 10.

FIG. 8 is a photograph showing the results of a reaction of hydrophilic gold nanoparticles with metallic salts and bases in comparison embodiments 2 to 10. Various sorts of metallic salts and bases were mixed with gold nanoparticles, and then the mixtures were heated in an oven at 100° C. for 10 minutes, and the color changes of the solution were observed. Referring to FIG. 8, it can be shown that all sorts of metallic salts and bases according to comparison embodiments 2 to 10 do not affect the dispersion states of the gold nanoparticles.

Next, instead of hydrochloric acid, sulfuric acid and nitric acid were mixed with the gold nanoparticles that had been prepared in preparing example 1 and then the mixture was heated in an oven at 100° C. for 10 minutes, and the color changes within the test tube were observed.

Exemplary Embodiment 8: A Method for Detecting Sulfuric Acid Using Gold Nanoparticles 4.5 μg of the gold nanoparticles that had been prepared in preparing example 1 were immersed in 1 ml of seven test tubes. Here, 10 ppm, 30 ppm, 50 ppm, 100 ppm, 300 ppm, 500 ppm and 1,000 ppm of sulfuric acid (Aldrich, (95-98)%) were poured in the test tubes, respectively, and the tubes were shaken for 3 seconds, and then the test tubes where the gold nanoparticles are mixed with aqueous solution of sulfuric acid were heated in an oven at 100° C. for 10 minutes, and the color changes within the test tubes were observed.

Exemplary Embodiment 9: A Method for Detecting Nitric Acid Using Gold Nanoparticles Except that 10 ppm, 30 ppm, 50 ppm, 100 ppm, 300 ppm, 500 ppm and 1,000 ppm of nitric acid(Aldrich, (70)%) were added to the test tubes, respectively, instead of sulfuric acid, the experiment was performed in the same method as exemplary embodiment 8, and the color changes within the test tubes were observed, respectively.

Results of Exemplary Embodiments 8 to 9 and Considerations Thereof

Figure 9A:
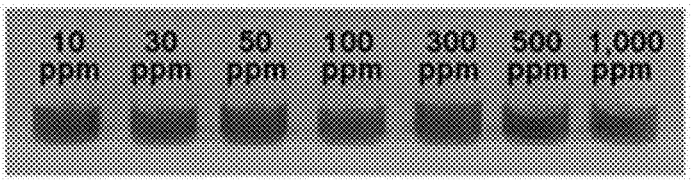
FIG. 9*a* is a photograph showing the result of a detection of sulfuric acid using gold nanoparticles prepared by exemplary embodiment 8 of the present invention.
Figure 9B:
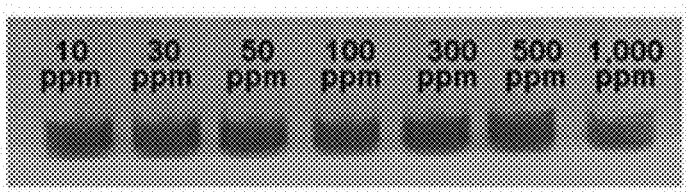
FIG. 9*b* is a photograph showing the result of a detection of nitric acid using gold nanoparticles prepared by exemplary embodiment 9.

FIG. 9*a* is a photograph showing the result of a detection of sulfuric acid using the gold nanoparticles in exemplary embodiment 8 and FIG. 9*b* is a photograph showing the result of a detection of nitric acid using the gold nanoparticles in exemplary embodiment 9. Referring to FIG. 9*a* and FIG. 9*b*, it can be shown that the color of sulfuric acid changes at 500 ppm whereas the color of nitric acid changes at 1000 ppm. Even though sulfuric acid and nitric acid are strong acids like hydrochloric acid, the reason why the color of solution is changed at higher concentration is that dissociation constant of hydrogen ion is smaller in the order of hydrochloric acid, sulfuric acid and nitric acid.

Exemplary Embodiment 10: A Method for Detecting Hydrochloric Acid Reusing Gold Nanoparticles First, 10 μg of NaOH (Aldrich, 97%) was added to a solution about which the detection of hydrochloric acid was completed according to exemplary embodiment 4 to neutralize the solution. An aqueous solution containing 5 ppm of hydrochloric acid in 100 μl of the water was poured in the neutralized solution and the mixture was shaken for 3 seconds, and then the test tube containing gold nanoparticles and hydrochloric acid was heated in an oven at 100° C. for 10 minutes.

Figure 10:
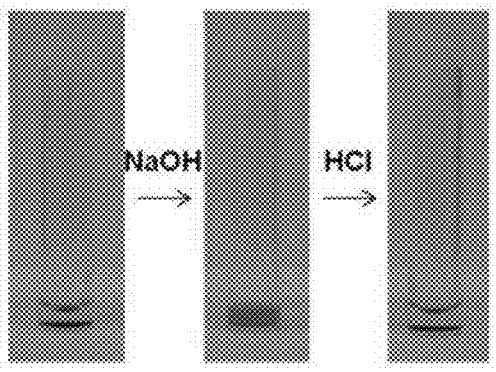
FIG. 10 is a photograph showing the result of a detection of hydrochloric acid reusing gold nanoparticles prepared by exemplary embodiment 10.

FIG. 10 is a photograph showing the result of a detection of hydrochloric acid reusing the gold nanoparticles in exemplary embodiment 10. Referring to FIG. 10, when NaOH is added to the gold nanoparticles that were agglomerated by the hydrochloric acid and precipitated, the agglomerated gold nanoparticles are to be dissociated through neutralization of hydrochloric acid and then re-dispersed in the water. Here, it can be known that red color disappears of the solution when 5 ppm of hydrochloric acid is added again. By this result, it can be known that the gold nanoparticles that were used in the detection of hydrochloric acid in exemplary embodiment 4 are stable electrostatically and cubically and thus such gold nanoparticles can be reused at the detection of hydrochloric acid.

Figure 11:
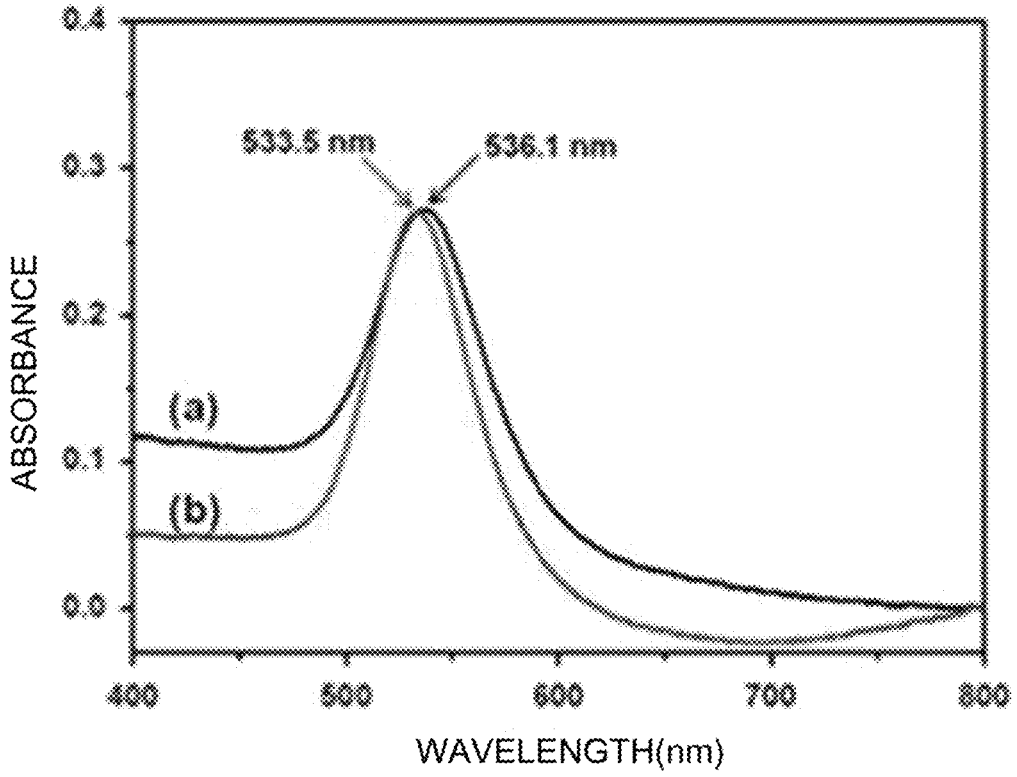
FIG. 11 is an UV/vis spectrum showing blue color transition of gold nanoparticles(b) that are reproduced with respect to the initial gold nanoparticles(a) prepared by exemplary embodiment 10.

FIG. 11 is an UV/vis spectrum showing blue color transition of gold nanoparticles(b) that are reproduced with respect to initial gold nanoparticles(a) according to exemplary embodiment 10. The UV-Vis spectrum was measured with UV-Vis spectrometer (JASCO V-530). According to FIG. 11, it can be known that reproduced gold nanoparticles (b) were blue color transited of 2.6 nm, and by this result it can be known that the reproduced gold nanoparticles(b) were slightly etched by chlorides.

According to an embodiment of the present invention, the size of nanoparticles that are prepared by adjusting volume ratio of surfactant can be controlled over a broad range. Additionally, up to 5 ppm of low content hydrochloric acid can be detected by utilizing phase transited hydrophilic nanoparticles in colorimetric detection for detecting aqueous strong acid after hydrophobic gold nanoparticles is phase transited into hydrophilic gold nanoparticles. The gold nanoparticles that are used in detecting strong acid can be reused without any loss of activity by neutralizing them with bases.

While the invention has been shown and described with reference to exemplary embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

What is claimed is:

1. A method of detecting a strong acid comprising: preparing mono-dispersed hydrophobic gold nanoparticles with 11 to 54 nm of average radius; preparing dispersed solution by dispersing the hydrophobic gold nanoparticles in chloroform; adding aqueous solution of 0.05 to 0.5M cetyltrimethyl ammonium bromide to the dispersed solution and magnetic-stirring it; yielding hydrophilic gold nanoparticles by separating centrifugally the mixture in which a reaction is completed and removing remaining surfactant; and adding an aqueous solution containing hydrochloric acid to a test tube where the hydrophilic gold nanoparticles are immersed, heating the test tube at 500° C.~1000° C. for 5 to 10 minutes and then observing color changes within the test tube, wherein the step of heating the test tube uses an oven, heater or a heating wire detachable and attachable to the test tube as a heat source.

2. The method of detecting a strong acid of claim 1, wherein the strong acid is hydrochloric acid, sulfuric acid or nitric acid.

3. The method of detecting a strong acid of claim 2, wherein the strong acid is hydrochloric acid.

4. The method of detecting a strong acid of claim 1, wherein the step of heating the test tube includes heating the test tube to a temperature of 100° C.

5. The method of detecting a strong acid of claim 1, further comprising a step of collecting the hydrophilic gold nanoparticles by adding NaOH to the test tube and neutralizing the solution within the test tube after observing the color changes within the test tube.

* * * * *